US008330655B2

(12) United States Patent
Zadesky et al.

(10) Patent No.: US 8,330,655 B2
(45) Date of Patent: Dec. 11, 2012

(54) CONNECTORS WITH EMBEDDED ANTENNAS

(75) Inventors: Stephen P. Zadesky, Portola Valley, CA (US); Christopher D. Prest, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 586 days.

(21) Appl. No.: 12/543,457

(22) Filed: Aug. 18, 2009

(65) Prior Publication Data

US 2011/0043413 A1 Feb. 24, 2011

(51) Int. Cl.
*H01Q 1/24* (2006.01)

(52) U.S. Cl. ..... 343/702; 343/906

(58) Field of Classification Search ..... 343/702, 343/767, 906

See application file for complete search history.

(56) References Cited

U.S. PATENT DOCUMENTS 5,596,337 A * 1/1997 Merenda ..... 343/770
5,726,666 A * 3/1998 Hoover et al. ..... 343/770
6,419,506 B2 7/2002 Jones et al.
6,975,274 B2 * 12/2005 Sanchez et al. ..... 343/702
7,231,236 B2 6/2007 Cho
7,466,289 B2 12/2008 Lin et al.
7,605,707 B2 * 10/2009 German et al. ..... 340/572.8
7,663,561 B2 * 2/2010 Hisaeda ..... 343/713
7,777,689 B2 * 8/2010 Fratti et al. ..... 343/895
2005/0253726 A1 11/2005 Yoshida et al.
2006/0049942 A1 3/2006 Sakama et al.
2008/0136716 A1 6/2008 Annamaa et al.
2008/0238783 A1 * 10/2008 Wong et al. ..... 343/700 MS
2009/0051621 A1 2/2009 Liang et al.

FOREIGN PATENT DOCUMENTS

EP 1 686 025 A2 8/2006
EP 2 083 472 7/2009

* cited by examiner

*Primary Examiner* — Tho G Phan
(74) *Attorney, Agent, or Firm* — Treyz Law Group; David C. Kellogg; G. Victor Treyz

(57) ABSTRACT

Connectors for electronic devices are provided with embedded antennas. The connectors may be 30-pin connectors. A 30-pin connector may have a conductive shell structure that defines a cavity and a planar dielectric member that extends into the cavity and that has contact pins. An antenna may be formed from an antenna resonating element on the planar dielectric member and an antenna ground formed from the conductive shell structure. An antenna may be formed from a slot in the conductive shell. The antenna and the pins may be electrically coupled to an electronic device using a cable.

20 Claims, 6 Drawing Sheets

CONNECTORS WITH EMBEDDED ANTENNAS

BACKGROUND

This invention relates generally to connectors for electronic devices, and more particularly, to connectors with embedded antennas for electronic devices.

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use wireless communications to communicate with wireless base stations.

To satisfy consumer demand for small form factor wireless devices, manufacturers are continually striving to reduce the size and number of components that are used in these devices. At the same time, manufacturers are continually striving to maximize the performance of wireless communications circuitry and antennas. With conventional wireless electronic devices, separate connector and antenna structures may take up an undesirably large amount of space in the devices.

It would therefore be desirable to be able to provide improved connectors and embedded antennas for electronic devices.

SUMMARY

In accordance with an embodiment of the present invention, connectors with embedded antennas are provided. The connectors may be a part of wireless electronic devices such as handheld electronic devices.

A connector in an electronic device may be used to couple the device with external equipment such as headset accessories and power adapters. The connector may convey data and power signals between the external equipment and the electronic device. The connector may include a conductive shell structure that forms a cavity and a planar dielectric member that extends into the cavity. Mating connectors from a plug associated with the external equipment may physically and electrically couple with the planar dielectric member and the conductive shell structure when the plug is coupled with the connector. With one suitable arrangement, the connector may be a 30-pin connector.

One or more antennas may be embedded in the connector. As an example, one or more strip antenna resonating element formed from conductive strips may be formed on the dielectric member structure in the connector. As another example, one or more slot antennas may be formed from holes in the conductive shell structure. If desired, combinations of strip antenna resonating elements, slot antennas, and other antenna structures may be embedded in the connector. In general, the antennas embedded in the connector may be used for communications in any suitable communications band. With one arrangement, the antennas may be used for communications in relatively short range communications bands such as the WiFi® (IEEE 802.11) band at 2.4 GHz and 5 GHZ and the Bluetooth® band at 2.4 GHz.

The connector may include electrical pins that convey data and power signals to external equipment. With one suitable arrangement, the antenna structures that are embedded in the connector and the electrical pins may be connected to various circuits in the electronic device using a shared cable. For example, a single cable with conductive lines may convey radio-frequency signals between transceiver circuitry and the antennas and may simultaneously convey data and power signals between the electrical pins and input-output circuitry in the electronic device.

Further features of the invention, its nature and various advantages will be more apparent from the accompanying drawings and the following detailed description of the preferred embodiments.

DETAILED DESCRIPTION

The present invention relates generally to connectors for electronic devices, and more particularly, to connectors with embedded antennas for electronic devices. Because a connector in an electronic device may be located in an exposed portion of the electronic device, an antenna embedded in a connector may have improved performance characteristics relative to an antenna housed within the interior of an electronic device. In addition, a connector with an embedded antenna may occupy less space in an electronic device than separate connector and antenna components.

With one suitable arrangement, an electronic device may include a connector such as a 30-pin connector that couples with a mating 30-pin plug associated with external equipment (sometimes referred to herein as an accessory). The connector may include an embedded antenna. If desired, the embedded antenna may be used only when external equipment is not coupled to the electronic device using the connector. Alternatively, the embedded antenna may be used even when external equipment is coupled to the electronic device using the connector.

The electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, which is sometimes described herein as an example, the portable electronic devices are handheld electronic devices. Handheld devices may be, for example, cellular telephones, media players with wireless communications capabilities, handheld computers (also sometimes called personal digital assistants), remote controllers, global positioning system (GPS) devices, and handheld gaming devices. The handheld devices may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, and supports web browsing. These are merely illustrative examples.

Figure 1:
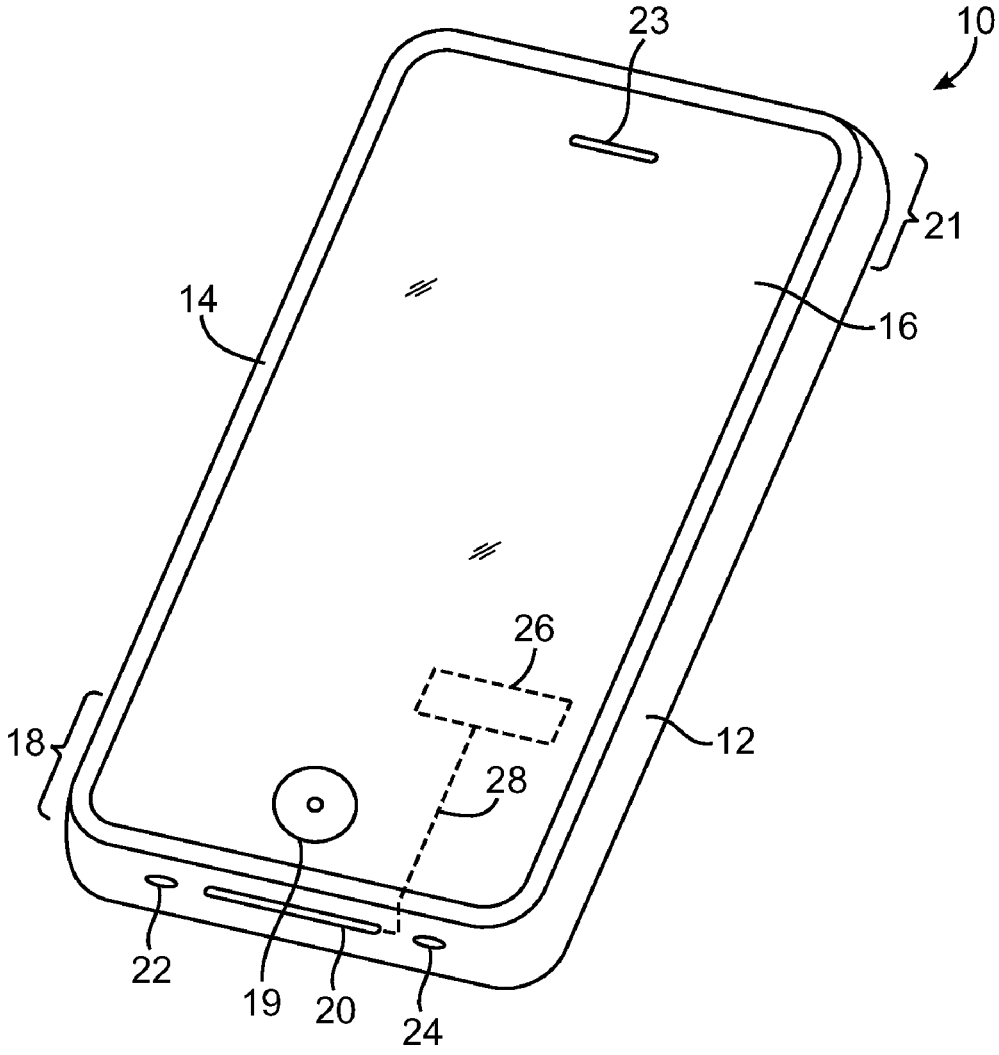
FIG. 1 is a perspective view of an illustrative handheld electronic device that may have a connector with an embedded antenna in accordance with an embodiment of the present invention.

An illustrative handheld electronic device in accordance with an embodiment of the present invention is shown in FIG. 1. Device 10 may be any suitable portable or handheld electronic device.

Device 10 may have housing 12. Device 10 may include one or more antennas for handling wireless communications. Embodiments of device 10 that contain one antenna and embodiments of device 10 that contain two or more antennas are sometimes described herein as examples.

Device 10 may handle communications over one or more communications bands. For example, in a device 10 with two antennas, a first of the two antennas may be used to handle cellular telephone communications in one or more frequency bands, whereas a second of the two antennas may be used to handle data communications in a separate communications band. With one suitable arrangement, which is sometimes described herein as an example, the second antenna is configured to handle data communications in a communications band centered at 2.4 GHz (e.g., WiFi and/or Bluetooth® frequencies). If desired, device 10 may communicate using cellular telephone bands at 850 MHz, 900 MHz, 1800 MHz, and 1900 MHz (e.g., the main Global System for Mobile Communications or GSM cellular telephone bands). Device 10 may also use other types of communications links. For example, device 10 may communicate using the WiFi® (IEEE 802.11) band at 2.4 GHz and 5 GHZ and the Bluetooth® band at 2.4 GHz. Communications are also possible in data service bands such as the 3 G data communications band at 2170 MHz band (commonly referred to as UMTS or Universal Mobile Telecommunications System).

Housing 12, which is sometimes referred to as a case, may be formed of any suitable materials including, plastic, glass, ceramics, metal, or other suitable materials, or a combination of these materials. In scenarios in which housing 12 is formed from metal elements, one or more of the metal elements may be used as part of the antennas and may be used as part of transmission lines in device 10. For example, metal portions of housing 12 may be shorted to one or more transmission line ground planes. Housing 12 may be shorted to an internal ground plane in device 10 to create a larger ground plane element for that device 10.

Housing 12 may have a bezel 14. Bezel 14 may be formed from a conductive material, if desired. Bezel 14 may serve to hold a display or other device with a planar surface in place on device 10. As shown in FIG. 1, for example, bezel 14 may be used to hold display 16 in place by attaching display 16 to housing 12.

Display 16 may be a liquid crystal diode (LCD) display, an organic light emitting diode (OLED) display, a plasma display, multiple displays that use one or more different display technologies, or any other suitable display. The outermost surface of display 16 may be formed from one or more plastic or glass layers. If desired, touch screen functionality may be integrated into display 16 or may be provided using a separate touch pad device.

Display screen 16 (e.g., a touch screen) is merely one example of an input-output device that may be used with handheld electronic device 10. If desired, handheld electronic device 10 may have other input-output devices. For example, handheld electronic device 10 may have user input control devices such as button 19, and input-output components such as port 20 and one or more input-output jacks (e.g., for audio and/or video). Button 19 may be, for example, a menu button. Port 20 may contain a 30-pin data connector (as an example). Openings 24 and 22 may, if desired, form microphone and speaker ports.

With one suitable arrangement, one or more antennas in device 10 are located in the lower end 18 of device 10. For example, one or more antennas in device 10 may be embedded in port 20 (which may sometimes be referred to herein as connector 20). The antenna structures that are formed in connector 20 may be coupled to radio-frequency transceiver circuitry such as circuitry 26 over communications path 28 (as one example).

Figure 2:
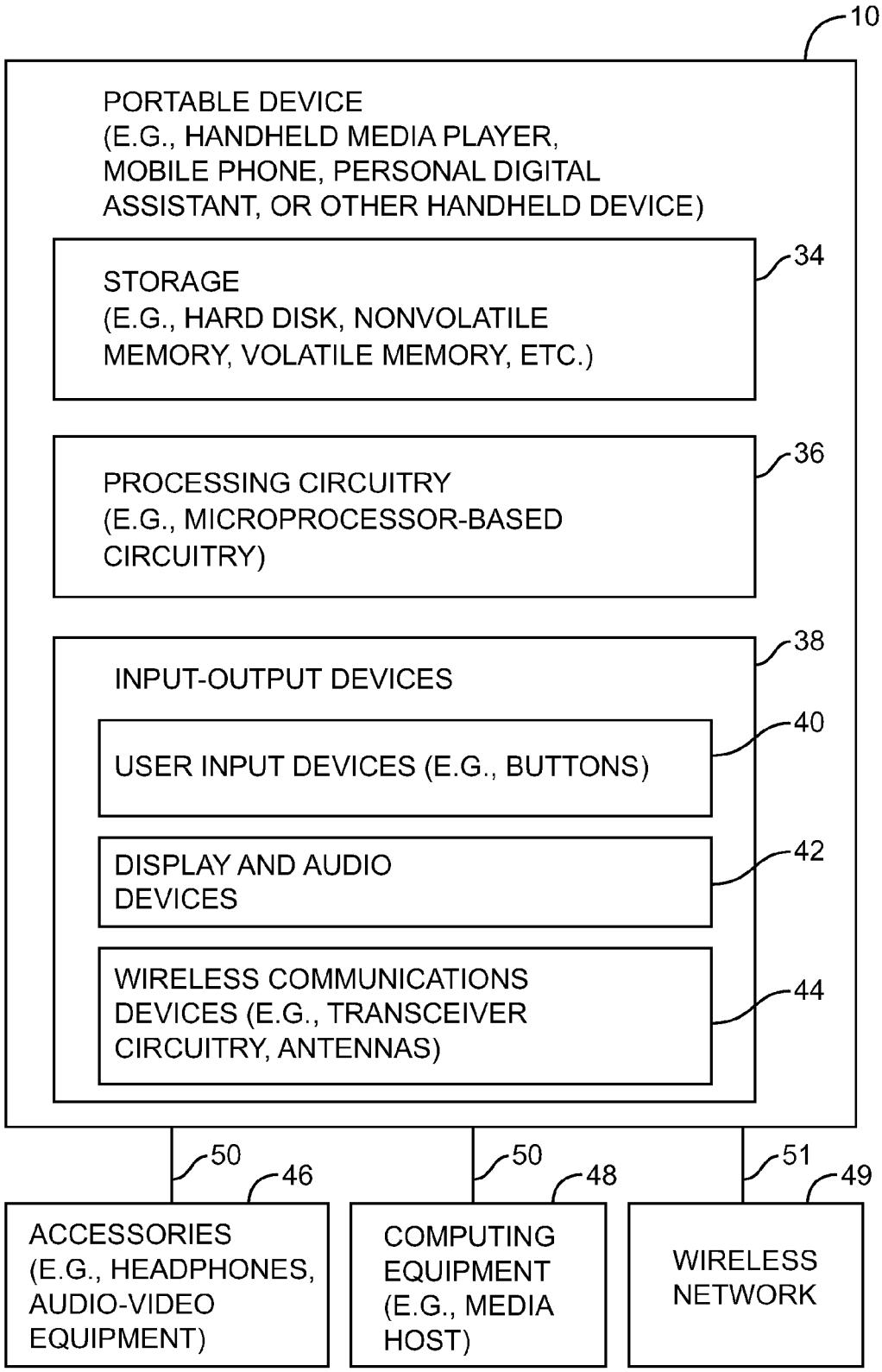
FIG. 2 is a schematic diagram of an illustrative handheld electronic device that may have a connector with an embedded antenna in accordance with an embodiment of the present invention.

A schematic diagram of an embodiment of an illustrative handheld electronic device is shown in FIG. 2. Handheld device 10 may be a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits.

Input-output devices 38 may be used to allow data to be supplied to device 10 and to allow data to be provided from device 10 to external devices. Display screen 16, button 19, microphone port 24, speaker port 22, and dock connector port 20 are examples of input-output devices 38.

Input-output devices 38 can include user input-output devices 40 such as buttons, touch screens, joysticks, click wheels, scrolling wheels, touch pads, key pads, keyboards, microphones, cameras, etc. Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, transmission lines, one or more antennas such as antennas embedded within connectors, and other circuitry for handling RF wireless signals.

Device 10 can communicate with external devices such as accessories 46 and computing equipment 48, as shown by paths 50. Paths 50 may include wired and wireless paths. For example, paths 50 may include wired paths formed using connector 20 of FIG. 1 and wireless paths formed using antennas embedded into connector 20. Accessories 46 may include headphones (e.g., a wireless cellular headset or audio headphones) and audio-video equipment (e.g., wireless speakers, a game controller, other equipment that receives and plays audio and video content), power supplies that provide power to device 10, etc.

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another handheld electronic device 10), or any other suitable computing equipment. Device 10 may use wireless communications circuitry 44 to communicate with wireless network 49 over wireless path 51.

Figure 3:
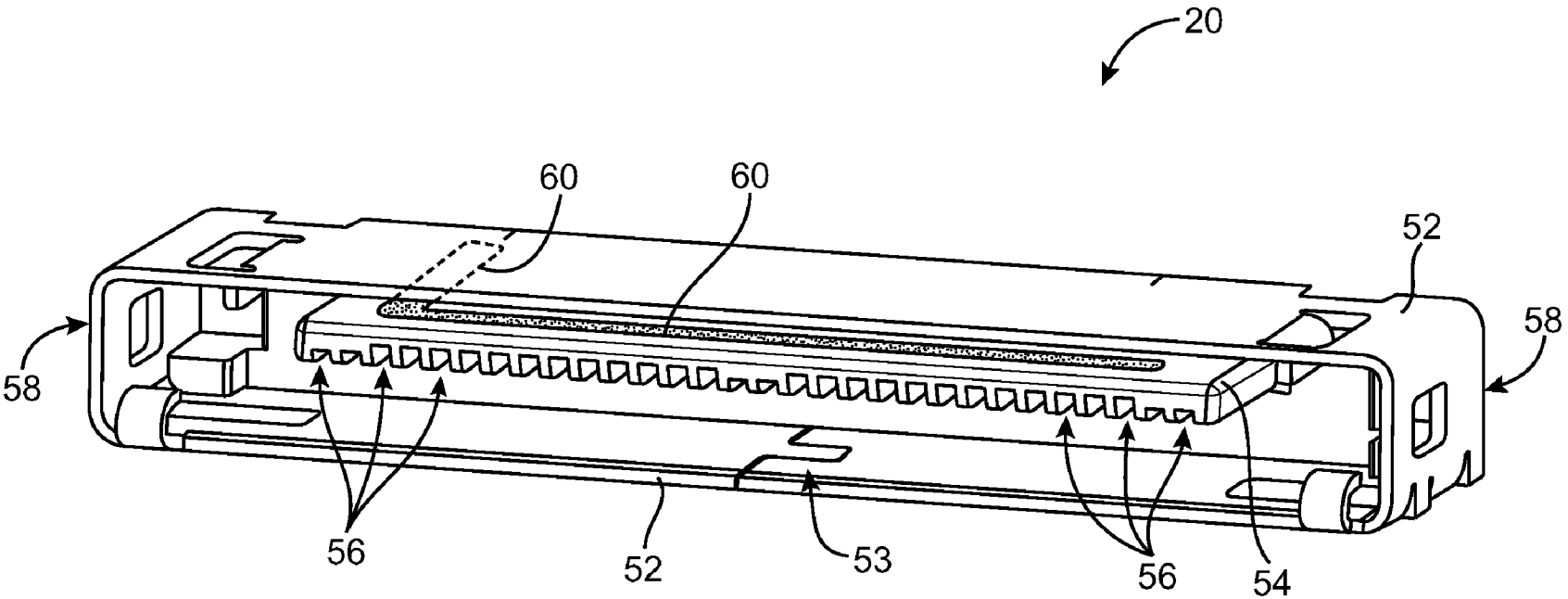
FIG. 3 is a perspective view of an illustrative connector that may have an antenna resonating element embedded in a dielectric member with pins that electrically connect to external equipment in accordance with an embodiment of the present invention.

A perspective view of an illustrative connector that may include an embedded antenna is shown in FIG. 3. The embedded antenna may include antenna resonating element 60. Antenna resonating element 60 may be used for radio-frequency communications in any suitable communications band. With one suitable arrangement, antenna resonating element 60 may be used for relatively short range communications bands such as the WiFi® (IEEE 802.11) band at 2.4 GHz and 5 GHZ and the Bluetooth® band at 2.4 GHz (as one example). As shown in FIG. 3, connector 20 may be formed from a conductive shell structure 52 that forms a cavity. Planar dielectric member 54 extends into the center of cavity. Shell structure 52 may be formed from a conductor such as metal (e.g., stainless steel). Shell structure 52 may sometimes be referred to as a frame.

Dielectric member 54 may be formed from a planar rigid dielectric substrate such as a sheet of fiberglass filled epoxy. If desired, member 54 may be formed from any suitable structure such as a planar dielectric member, a rigid printed circuit board, a printed circuit board, an insert molded plastic piece, a flexible circuit, a flexible structure, or other suitable structures, or a combination of these structures. With an insert molding, conductive members in dielectric member 54 such as pins 56 and element 60 may be placed in a mold and the mold may then be filled with a plastic to form dielectric member 54 (as one example). Member 54 may include conductive pins 56. Pins 56 may be any suitable conductive contacts. With one suitable arrangement, pins 56 and antenna resonating element 60 may be formed on opposite sides of dielectric member 54. Pins 56 may electrically couple to corresponding conductive pins in a connector that is part of external equipment such as accessory 46 of FIG. 2 when accessory 46 is coupled to device 10. As one example, pins 56 may form conductive paths that convey data and power signals between device 10 and external equipment. If desired, shell structure 52 of connector 20 may form part of the communications path connecting device 10 with external equipment. For example, shell structure 52 may serve as a ground path through which the external equipment can be grounded to device 10.

Shell structure 52 may be formed from a single piece of conductive metal (e.g., metal) that is folded together and joined at joint portion 53. If desired, shell structure 52 may be formed from multiple structures. These structures may be held together using any suitable technique (i.e., welded, soldered, glued, mechanically linked using fasteners such as screws, etc.).

Portions 58 of connector 20 may engage with retaining clips in a connector for external equipment. With this type of arrangement, the connector for the external equipment may be physically secured in connector 20 by the retaining clips engaged in portions 58. If desired, some or all of shell structure 52 may be formed from portions of housing 12 in device 10 that surround connector 20 (see, e.g., FIG. 1).

Antenna resonating element 60 may operate in conjunction with an antenna ground element (e.g., conductive shell 52) to form an antenna for device 10. Antenna resonating element 60 may be formed in dielectric member 54 that extends into the cavity formed by shell structure 52 (as one example). For example, antenna resonating element 60 may be insert molded into a plastic part (e.g., the dielectric member 54) that surrounds the conductive pins 56. As other examples, antenna resonating element 60 may be formed from an exposed conductive trace on the surface of dielectric member 54 or from a conductive trace that is covered by a dielectric material (e.g., a protective material that may reduce wear on the antenna resonating element).

As shown in FIG. 3, antenna resonating element 60 may be an L-shaped strip antenna resonating element with a relatively long portion along the length of dielectric member 54 and a relatively short portion along the depth of dielectric member 54 (as one example). In the FIG. 3 perspective, portions of the short potion of resonating element 60 that are obscured by shell structure 52 are illustrated with dotted lines. If desired, antenna resonating element 60 may be electrically coupled to conductive traces in dielectric member 54 using internal vias and interconnectors and surface contacts.

Figure 4:
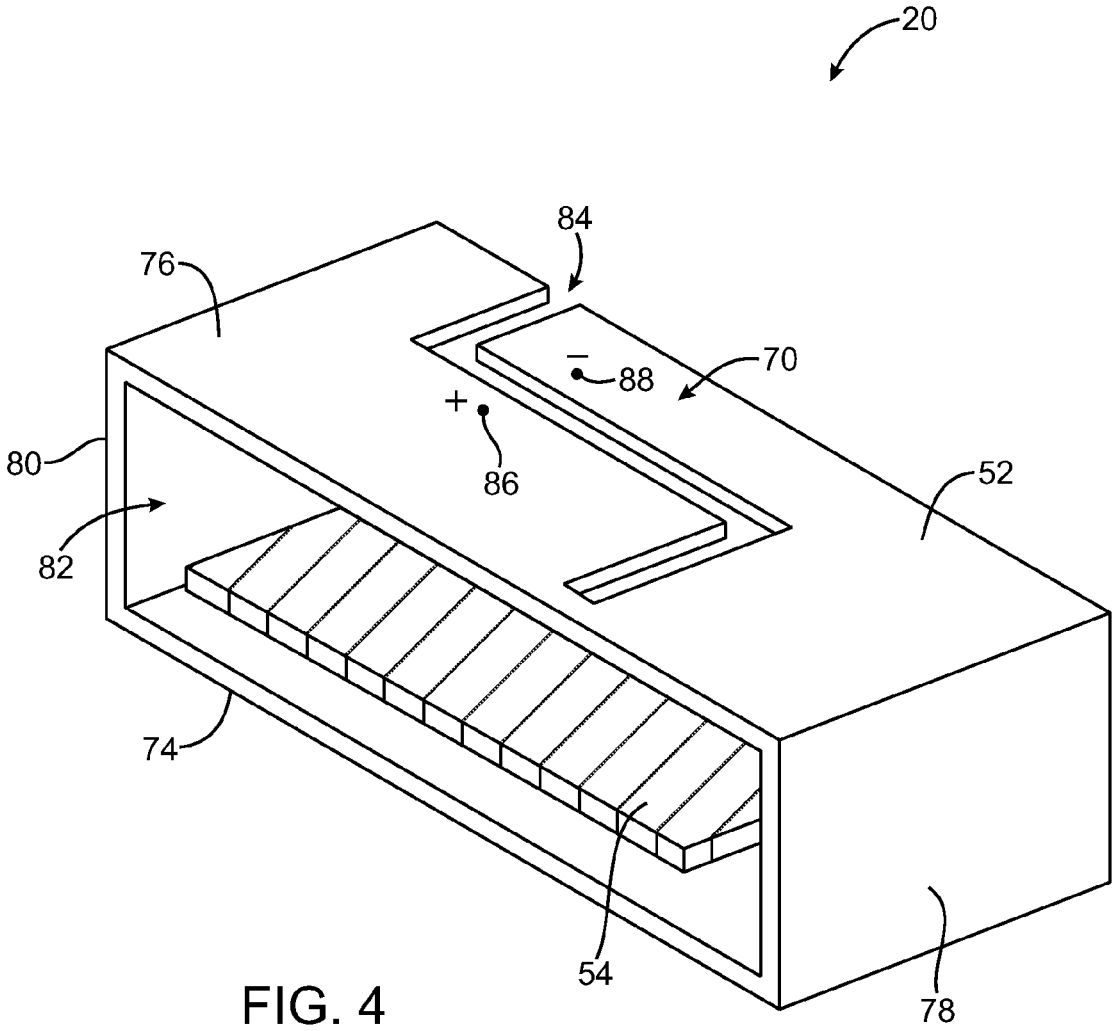
FIG. 4 is a perspective view of an illustrative connector with a conductive shell that may include a slot antenna in accordance with an embodiment of the present invention.
Figure 5:
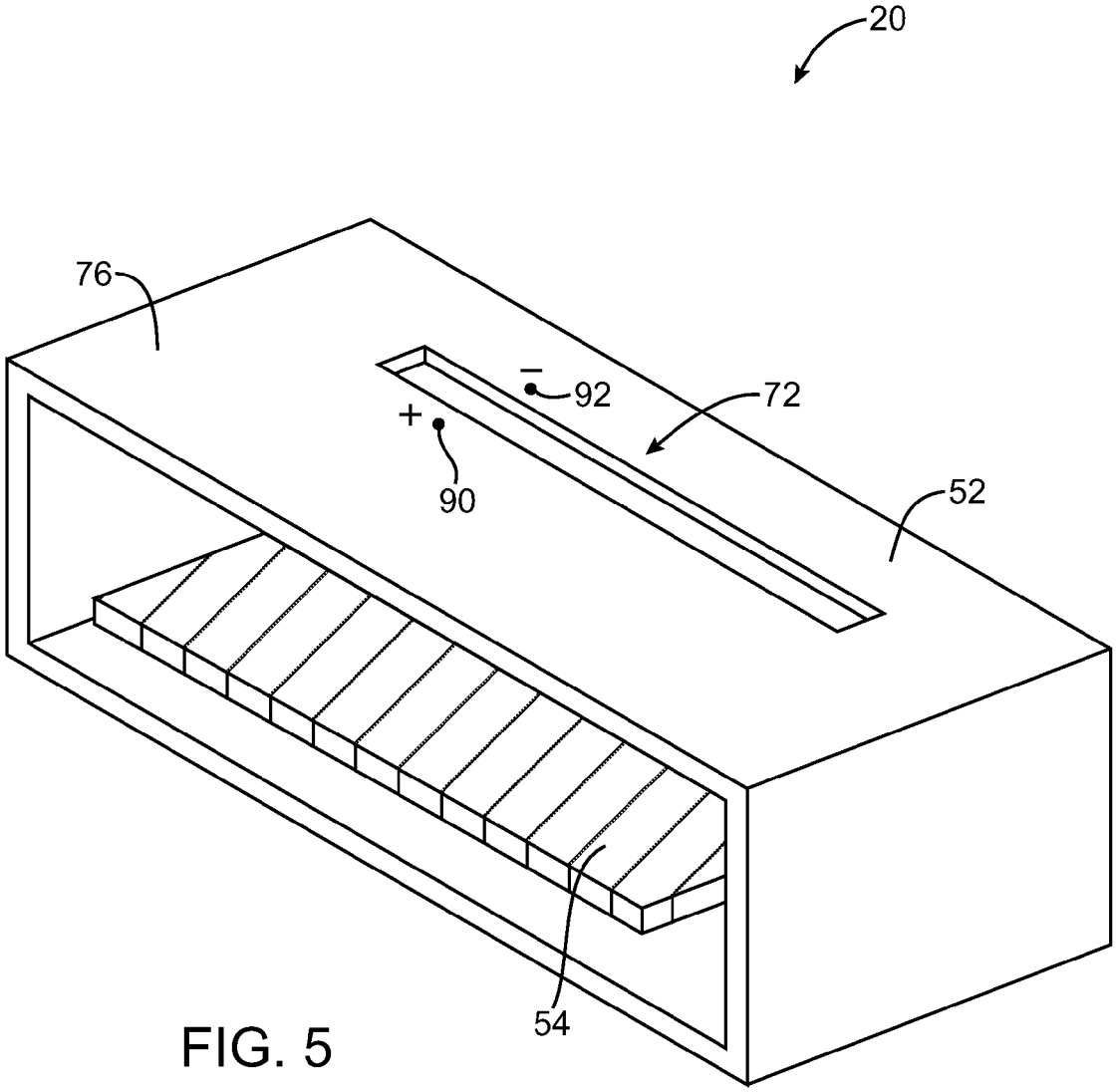
FIG. 5 is a perspective view of an illustrative connector with a conductive shell that may include a closed slot antenna in accordance with an embodiment of the present invention.

In general, antenna structures may be formed in any desired portion of connector 20. For example, antenna structures may be formed as part of conductive shell structure 52 as illustrated in FIGS. 4 and 5. As shown in the FIG. 4 example, connector 20 may include one or more slot antennas such as open slot antenna 70. As shown in the FIG. 5 example, connector 20 may include one or more closed slot antennas such as antenna 72.

Slot antennas 70 and 72 may be formed on any suitable portion of conductive shell structure 52. As illustrated in FIG. 4, structure 52 may be formed from a pair of parallel planar structures 74 and 76 and a pair of parallel planar end structures 78 and 80 that are perpendicular to structure 74 and 76. With this type of arrangement, structure 52 may form a rectangular hollow box-shaped structure that defines a cavity 82 between the structures 74, 76, 78, and 80. Cavity 82 may be at least partially filled by dielectric member 54. While antennas 70 and 72 are formed on structure 76 in the examples of FIGS. 4 and 5, slot antennas such as antennas 70 and 72 may, in general, be formed on structures 74, 78, and/or 80.

With one suitable arrangement, slot antennas 70 and 72 may be used for relatively short range communications bands such as the WiFi® (IEEE 802.11) band at 2.4 GHz and 5 GHZ and the Bluetooth® band at 2.4 GHz (as one example). In general, slot antennas 70 and 72 may be used for any desired communications band. Connector 20 may include combinations of slot antennas such as slot antennas 70 and 72 and antennas embedded in dielectric member 54 such as an antenna formed from antenna resonating element 60 of FIG. 3, if desired.

As shown in the FIG. 4 arrangement, slot antenna 70 may be formed using an open slot. With an open slot arrangement, a slot antenna embedded in connector 20 may be formed by portions of shell structure 52 that define antenna 70 (e.g., a hole in structure 52). In particular, structure 52 may include a hole that extends to an edge or exterior portion of structure 52 so that antenna 70 has at least one open end such as end 84.

Antenna 70 may be fed at positive antenna feed terminal 86 and ground antenna feed terminal 88.

Slot antenna 72 (FIG. 5) may be formed using a closed slot. With a closed arrangement, portions of shell structure 52 that define antenna 72 may completely surround and enclose antenna 72. Antenna 72 may fed at positive antenna feed terminal 90 and ground antenna feed terminal 92.

The locations of terminals 86 and 88 in the FIG. 4 arrangement and terminals 90 and 92 in the FIG. 5 arrangement are merely illustrative. The locations of terminals 86 and 88 may be altered to selectively tune antenna 70 for operation in any number of suitable frequency ranges. Similarly, the locations of terminals 90 and 92 may be altered to selectively tune antenna 72.

Figure 6:
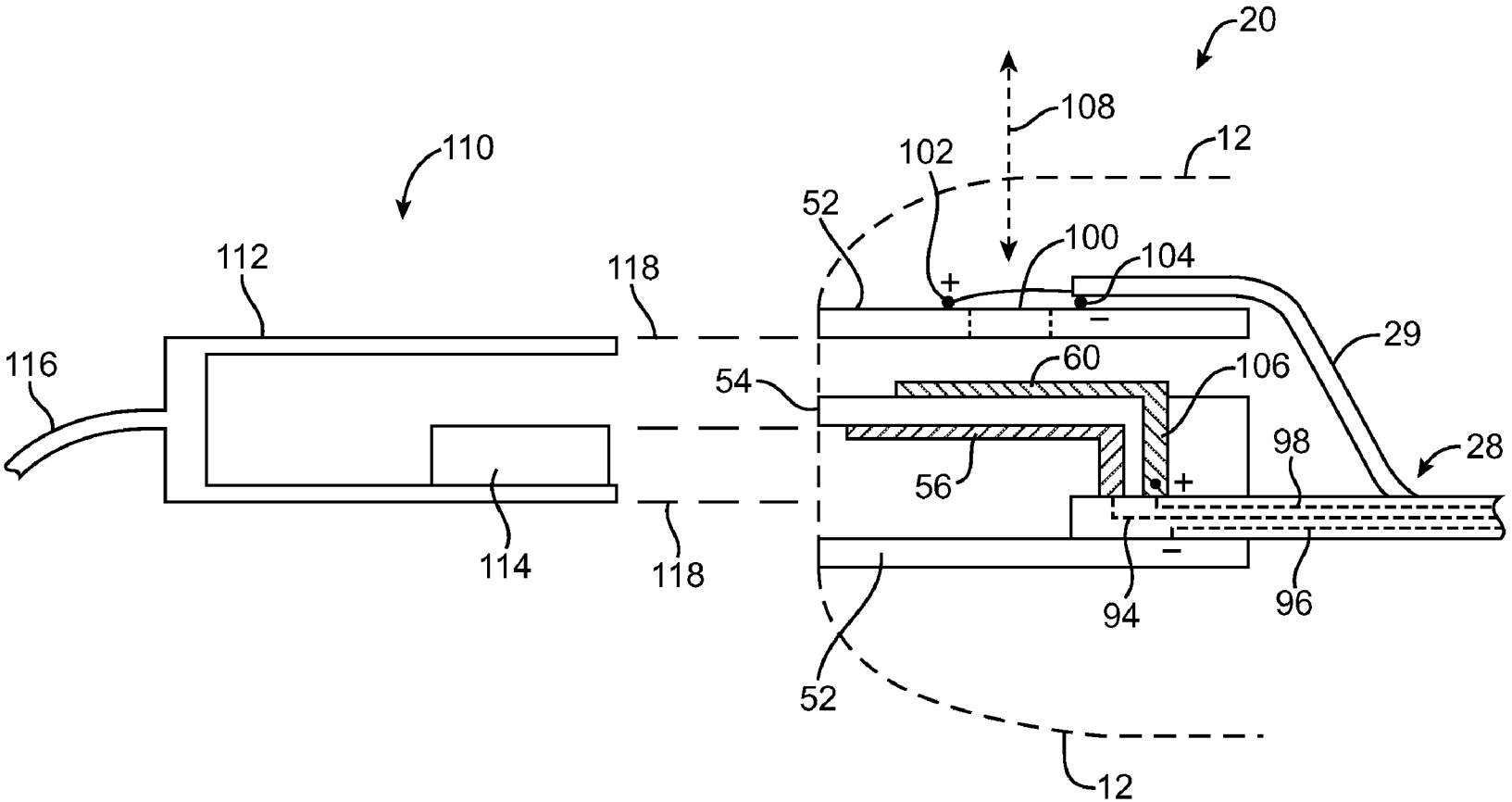
FIG. 6 is a cross-sectional side view of external equipment and an illustrative connector that may have an embedded antenna and that may connect to the external equipment in accordance with an embodiment of the present invention.

As shown in FIG. 6, a single shared cable such as cable 28 may be used to couple circuitry in device 10 to pins 56, antenna resonating element 60, and an antenna ground plane such as conductive shell structure 52. Cable 28 may include conductors such as conductor 94 that are connected to pins 56. Cable 28 may also include conductors such as conductors 96 and 98 (e.g., ground and positive feed lines) that are connected to structure 52 and antenna resonating element 60, respectively. As illustrated in FIG. 6, antenna resonating element 60 may include a via such as via 106 and interconnects that extend through dielectric member 54 to connect with conductor 98.

When connector 20 includes slot antenna 100 (e.g., a slot antenna such as antennas 70 and 72 of FIGS. 4 and 5), cable 28 may include a portion 29 that conveys signals to and from positive feed terminal 102 and ground terminal 104 (as an example). If desired, terminals 102 and 104 may be on the exterior of shell structure 52 (rather than in the cavity formed by structure 52. Placing terminals 102 and 104 on the exterior of structure 52 may reduce the risk of plug 110 damaging terminals 102 and 104. With one suitable arrangement, slot antenna 100 may transmit and receive radio-frequency communications signals along direction 108 (e.g., through housing 12 which is illustrated with dotted lines in the FIG. 6 example). This type of arrangement may facilitate radio-frequency communications even when plug 110 is coupled to connector 20.

If desired, cable 28 may be formed from a flexible printed circuit (sometimes referred to as a flex circuit). Flex circuits may be formed from flexible polymer sheets such as sheets of polyimide. Conductors 96 and 98 in cable 28 may convey radio-frequency signals between antenna resonating element 60 and radio-frequency transceiver circuitry in device 10 such as circuitry 26 (FIG. 1). Conductors in portion 29 of cable 28 may convey radio-frequency signals between slot antenna 100 and transceiver circuitry such as circuitry 26.

As illustrated by FIG. 6, a plug from external equipment such as accessories 46 and computing equipment 48 of FIG. 2 may connect to connector 20. Plug 110 may include structure 112 that houses conductive pins 114 and that mates with connector 20. Conductive pins 114 may electrically connect conductors in path 116 to conductors in path 28 such as conductors 94. As shown by dotted lines 118, plug 110 may slid into the cavity formed by shell structure 52.

In general, antennas in connector 20 may be formed using any suitable antenna structures. As examples, connector 20 may include embedded antennas formed from antenna structures such as inverted-F antennas (IFAs), planar inverted-F antennas (PIFAs), dipole antennas, loop antennas, patch antennas, other suitable antenna structures, or a combination of these antenna structures.

The foregoing is merely illustrative of the principles of this invention and various modifications can be made by those skilled in the art without departing from the scope and spirit of the invention.

What is claimed is:

1. A connector comprising:

a shell structure that defines a cavity that is configured to receive a mating connector associated with external equipment;

a planar dielectric member that extends into the cavity, wherein the planar dielectric member is configured to physically couple with the mating connector associated with the external equipment; and an antenna resonating element formed on the planar dielectric member, wherein the connector is in an electronic device.

2. The connector defined in claim 1 wherein the antenna resonating element comprises a strip antenna resonating element having a bend.

3. The connector defined in claim 1 wherein the antenna resonating element comprises a strip of metal embedded in the planar dielectric member and wherein the shell structure forms an antenna ground element.

4. The connector defined in claim 1 wherein the antenna resonating element comprises a conductive trace on the planar dielectric member.

5. A connector in an electronic device, comprising:

a shell structure that defines a cavity that is configured to receive a mating connector associated with external equipment;

a planar dielectric member that extends into the cavity; and an antenna resonating element formed on the planar dielectric member, wherein the planar dielectric member includes internal interconnect structures and wherein one of the internal interconnect structures connects to the antenna resonating element.

6. A connector in an electronic device, comprising:

a shell structure that defines a cavity that is configured to receive a mating connector associated with external equipment;

a planar dielectric member that extends into the cavity; and an antenna resonating element formed on the planar dielectric member, wherein the planar dielectric member comprises a plurality of conductive pins that electrically couple with mating pins in the mating connector.

7. The connector defined in claim 6 further comprising:

surface contacts on the planar dielectric member, wherein the surface contacts include at least one surface contact that electrically connects the antenna resonating element to an internal interconnect in the planar dielectric member; and a cable having a plurality of conductive lines, wherein at least one of the conductive lines is coupled to the surface contact that is connected to the antenna resonating element and wherein some of the conductive lines are coupled to the conductive pins.

8. The connector defined in claim 7 wherein the shell structure comprises a conductive shell structure and wherein one of the conductive lines is coupled to the conductive shell structure.

9. A connector in an electronic device, comprising:

a shell structure that defines a cavity that is configured to receive a mating connector associated with external equipment;

a planar dielectric member that extends into the cavity; and an antenna resonating element formed on the planar dielectric member, wherein the planar dielectric member comprises at least 30 conductive pins and wherein at least some of the conductive pins electrically couple with external connectors.

10. A connector comprising:

a conductive shell structure that defines a cavity that receives a connector plug associated with external equipment, wherein the conductive shell structure is configured to physically couple with the connector plug associated with the external equipment; and a slot antenna formed from an opening in the conductive shell structure, wherein the connector is in an electronic device.

11. The connector defined in claim 10 wherein the conductive shell structure comprises a first planar structure in a first plane and a second planar structure in a second plane and wherein the first and second planes are parallel.

12. The connector defined in claim 11 wherein the conductive shell structure comprises a third planar structure in a third plane and a fourth planar structure in a fourth plane, wherein the third and fourth planes are parallel, wherein the first and second planes are perpendicular to the third and fourth planes, and wherein the opening is formed in the first planar structure.

13. The connector defined in claim 10 wherein the slot antenna comprises a closed slot antenna in which the opening has a periphery that is completely enclosed by portions of the conductive shell structure.

14. The connector defined in claim 10 wherein the slot antenna comprises an open slot antenna in which the opening has at least one portion that extends to an edge of the conductive shell structure and that is not surrounded by the conductive shell structure.

15. The connector defined in claim 10 further comprising at least one additional slot antenna formed from an additional opening in the conductive shell structure.

16. The connector defined in claim 10 wherein the opening that forms the slot antenna includes at least one bend.

17. An electronic device comprising:

radio-frequency transceiver circuitry;

processing circuitry;

a connector comprising:

a conductive shell structure that defines a cavity and serves as an antenna ground;

a planar dielectric member that extends into the cavity and that includes a plurality of conductive pins; and an antenna resonating element on the planar dielectric member; and a cable having a plurality of conductive lines, wherein the cable is coupled between the radio-frequency transceiver circuitry and the antenna resonating element and antenna ground and wherein the cable is coupled between the processing circuitry and the conductive pins.

18. The electronic device defined in claim 17 wherein the antenna resonating element has an L-shape.

19. The electronic device defined in claim 17 wherein the antenna resonating element comprises a metal strip embedded in the planar dielectric member.

20. The electronic device defined in claim 17 wherein the conductive pins comprise at least 30 conductive pins and wherein at least some of the conductive pins electrically couple with a mating connector associated with external equipment.

* * * * *